US009783360B2

(12) United States Patent
Giordano et al.

(10) Patent No.: US 9,783,360 B2
(45) Date of Patent: Oct. 10, 2017

(54) SYSTEM AND METHOD FOR DISPENSING PRESSURIZED FLUID

(71) Applicant: Draco Sound, Corp., Canton, MA (US)

(72) Inventors: Charles Giordano, Canton, MA (US); David Swett, Waltham, MA (US)

(73) Assignee: Draco Sound, Corp., Canton, MA (US)

( * ) Notice: Subject to any disclaimer, the term of this patent is extended or adjusted under 35 U.S.C. 154(b) by 0 days.

(21) Appl. No.: 15/131,636

(22) Filed: Apr. 18, 2016

(65) Prior Publication Data

US 2016/0347534 A1 Dec. 1, 2016

Related U.S. Application Data

(63) Continuation-in-part of application No. 14/723,777, filed on May 28, 2015.

(60) Provisional application No. 62/186,490, filed on Jun. 30, 2015.

(51) Int. Cl.
*B65D 83/14* (2006.01)
*B65D 83/54* (2006.01)
*B65D 83/20* (2006.01)

(52) U.S. Cl.
CPC ..... *B65D 83/546* (2013.01); *B65D 83/201* (2013.01); *B65D 83/207* (2013.01)

(58) Field of Classification Search
CPC .... B65D 83/201; B65D 83/54; B65D 83/546; B65D 83/525; A61M 15/0066
USPC ..... 222/438, 305, 354, 355, 425, 402.2, 222/402.1–402.25, 239, 182, 206–209, 222/335, 309; 137/627.5
See application file for complete search history.

(56) References Cited

U.S. PATENT DOCUMENTS 3,138,301 A * 6/1964 Ward ..... B65D 7/40 222/335
3,221,946 A * 12/1965 Riley ..... B65D 83/44 222/309
3,231,150 A * 1/1966 Holm ..... B65D 83/546 222/288
3,377,004 A 4/1968 Kjelson
3,858,771 A * 1/1975 Bret ..... B65D 83/546 222/402.2
4,161,264 A * 7/1979 Malmgren ..... A61M 1/1656 222/135
4,809,888 A * 3/1989 Suck ..... B65D 83/546 137/625.68
5,137,175 A 8/1992 Kowalski et al.
5,501,375 A 3/1996 Nilson
5,588,565 A 12/1996 Miller
6,273,304 B1 * 8/2001 Hoshino ..... B65D 83/54 222/402.2
6,866,038 B2 * 3/2005 Bacon ..... F16K 7/068 128/200.14
7,699,192 B2 * 4/2010 Dunne ..... G01F 11/28 222/153.11

(Continued)

OTHER PUBLICATIONS

International Search Report and Written Opinion mailed Jul. 29, 2016 in corresponding PCT/US16/28098.

(Continued)

*Primary Examiner* — Charles P Cheyney
(74) *Attorney, Agent, or Firm* — Grossman, Tucker, Perreault & Pfleger, PLLC

(57) ABSTRACT

A system and method for dispensing a metered amount of liquid from a pressurized canister is provided.

13 Claims, 5 Drawing Sheets

(56) References Cited

U.S. PATENT DOCUMENTS

2010/0006601 A1 1/2010 De Man et al.

OTHER PUBLICATIONS

Office Action mailed Oct. 4, 2016 in corresponding U.S. Appl. No. 14/723,777.

* cited by examiner

SYSTEM AND METHOD FOR DISPENSING PRESSURIZED FLUID

CROSS REFERENCE

The present application claims the benefit of U.S. Provisional Application Ser. No. 62/186,490, filed Jun. 30, 2015, which is fully incorporated herein by reference. The present application is also a continuation-in-part of U.S. Ser. No. 14/723,777, filed May 28, 2015, which is fully incorporated herein by reference.

FIELD

The present application relates to a system and method for dispensing fluid from a pressurized canister. More specifically, it relates to a system and method for dispensing a metered amount of fluid.

BACKGROUND

Pressurized canisters that dispense fluid are known in the art. The fluid is expelled through a dispensing valve and expansion nozzle to atmospheric pressure.

The traditional dispensing system for such a pressurized canister is a normally-closed, push-to-open, release-to-close valve. The user interaction with this valve is inexact, and the system depends on the user to meter and dispense the amount of liquid by manually opening the valve until the desired amount of liquid is dispensed and then releasing the valve. To add to the imprecision of the dispensed amount of liquid, the volume of the liquid may change during and after expulsion, making the process of judging "visually" the amount of liquid dispensed difficult during the user's interaction with the valve. If the user holds the valve open too long, he dispenses too much liquid.

SUMMARY

According to one embodiment, a system is provided to seal a first end of an elastic tube to a pressurized canister's dispense valve and to activate the valve through an application of user force. The second end of the elastic tube is connected to a release valve that communicates fluidically between the elastic tube and an expansion nozzle that is open to the outside environment. There is also provided a confined space to contain the elastic tube, the volume of which confined space can be adjusted to set the maximum displacement of the elastic tube, thereby setting the maximum amount of liquid contained in the elastic tube.

A rigid structure detachably affixed to the pressurized canister holds the first end of the elastic tube to the dispense valve of a pressurized canister. The elastic tube is enclosed by a confined space of adjustable volume. The second end of the elastic tube is affixed to a release valve comprised of a pinch bar bearing transversely on the elastic tube wall against an anvil.

During operation, a user activates a trigger, which pivots against the rigid structure and bears upon the pinch bar. The subsequent loading of the pinch bar against the elastic tube and the anvil seals the release valve shut, and simultaneously opens the dispense valve on the pressurized canister releasing liquid into the elastic tube until the pressure in the elastic tube is the same as the pressure in the pressurized canister. After the elastic tube expands to fill the confined space, the user releases the trigger, closing the dispense valve on the pressurized canister and opening the release valve. The elastic tube then contracts expelling the liquid through the expansion nozzle until the pressure in the elastic tube returns to atmospheric pressure.

These aspects are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the present disclosure will be apparent from the following description of particular embodiments, as illustrated in the accompanying drawings in which like reference characters refer to the same parts throughout the different views. The drawings are not necessarily to scale, emphasis instead being placed upon illustrating the principles of the disclosure.

DETAILED DESCRIPTION

A system and method for dispensing metered amounts of liquid from a pressurized canister is provided. This dispensing system comprises a detachable seal to the canister, an elastic tube, a means to adjust the capacity of the elastic tube, a release valve, and an expansion nozzle. The detachable seal allows the system to be exchanged among multiple pressurized canisters as the liquid in each canister is depleted.

Referring to FIGS. 1-7 in which like reference numbers refer to like elements, there is shown one embodiment of the dispensing system 40 of the present disclosure.

Figure 1:
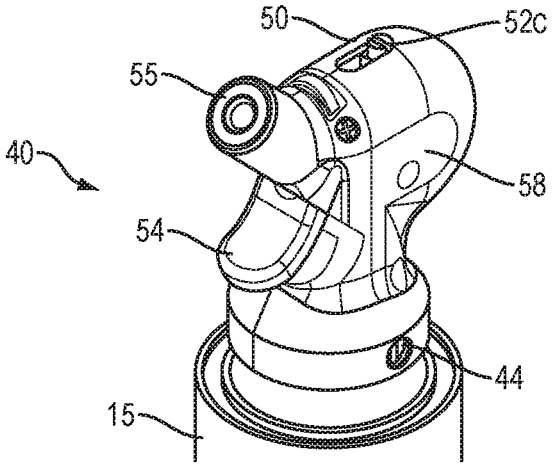
FIG. 1 is a front perspective view of one embodiment of the dispensing system of the present disclosure installed on a typical pressurized canister.
Figure 2:
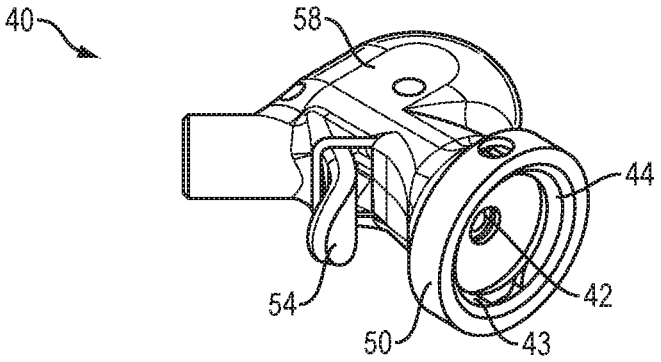
FIG. 2 is a bottom perspective view of an embodiment of the dispensing system of the present disclosure.
Figure 3:
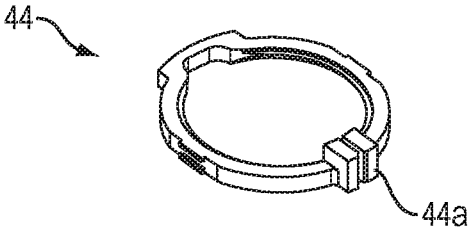
FIG. 3 is a detailed view of the valve activator ring of dispensing system of the present disclosure.
Figure 4:
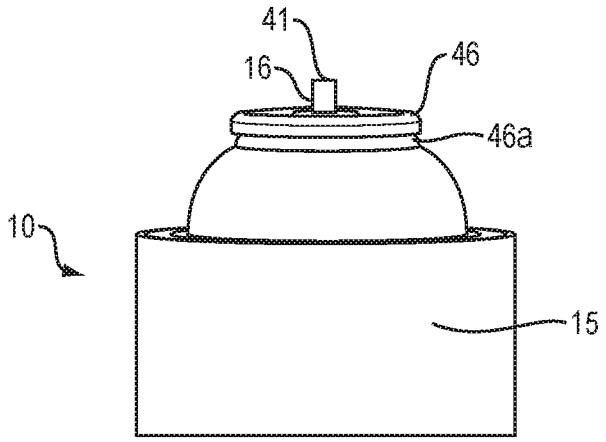
FIG. 4 is a side perspective view of a typical pressurized canister with which the dispensing system of the present disclosure can be used.

The dispensing system 40, as shown in FIGS. 1 and 2, seals to the nipple 41 of a valve 16 on a standard pressurized canister 10, as shown in FIG. 4. It seals fluidically with an elastic circumferential seal 42 on the dispensing system 40. A mounting collar 43 centers the dispensing system 40 to the valve crimp ring 46 of the pressurized canister 10, and an expandable locking ring 44 expands over the valve crimp ring 46 and contracts underneath to lock underneath the valve crimp ring undercut 46*a*, affixing the dispensing system 40 to the pressurized canister 10. By inserting a wedge into the expandable locking ring gap 44*a*, as shown in FIG. 3, the expandable locking ring 44 can be expanded to pass over the valve crimp ring undercut 46*a* and release the dispensing system 40 from the pressurized canister 10.

Figure 5:
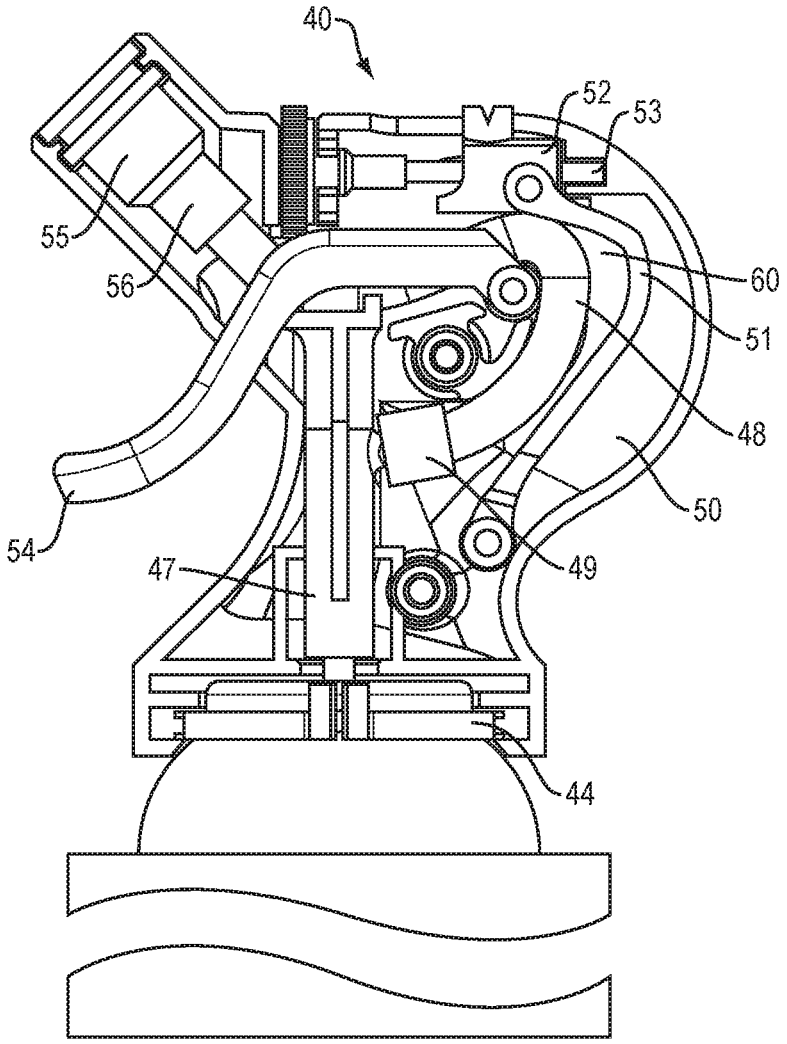
FIG. 5 is a front perspective view of an embodiment of the dispensing system of the present disclosure with the left cover removed.
Figure 6:
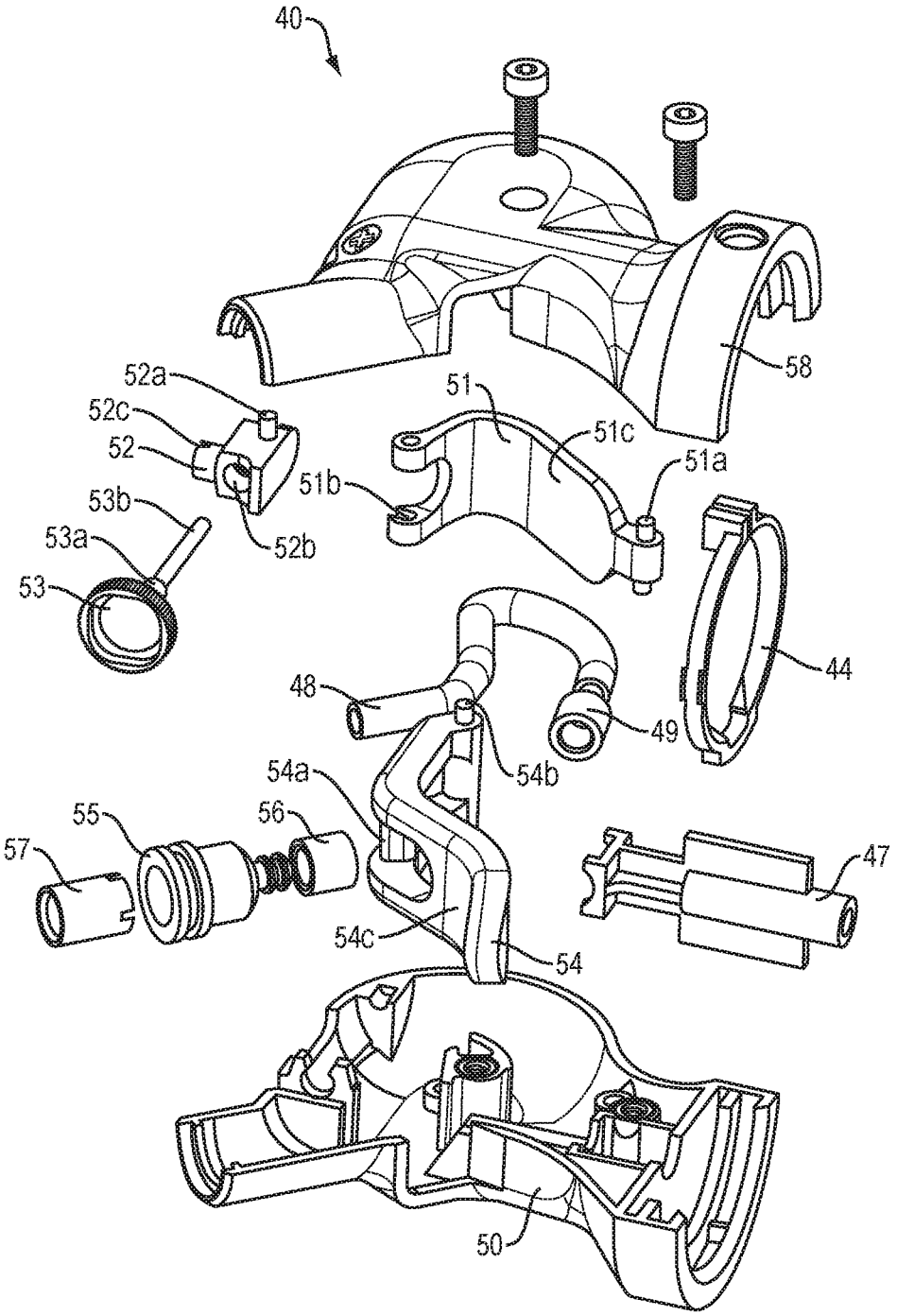
FIG. 6 is an exploded front perspective view of an embodiment of the dispensing system of the present disclosure.
Figure 7:
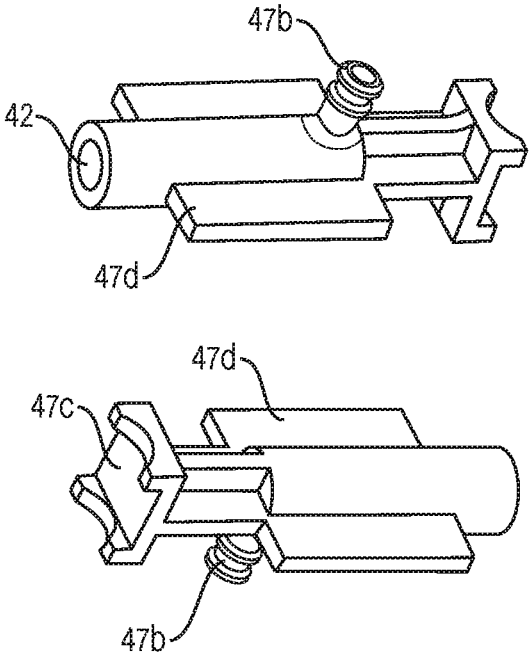
FIG. 7 is a detailed view of the valve actuator of the dispensing system of the present disclosure.

As shown in FIGS. 5 and 6, the nipple 41 of the pressurized canister valve 16 is fluidically connected to an elastic tube 48 via the valve actuator 47. Specifically, the elastic tube 48 is sealed fluidically to the valve actuator nipple 47*b* by the compression fit caused by a tube sealing nut 49. The elastic tube 48 is routed between a right housing shoe 50 and an adjustable volume stop 51. The elastic tube 48 then passes between a trigger seal 54*a* and a valve actuator anvil 47*c*, as shown in FIG. 7 on the valve actuator 47. The elastic tube 48 is then connected to an expansion nozzle 55 by the compression fit caused by a nozzle sealing nut 56.

Again, as shown in FIG. 7, the valve actuator has valve actuator slide ribs 47*d*. The valve actuator 47 is constrained by the valve actuator slide ribs 47*d* to move axially relative to the nipple 41 of the pressurized canister valve 16 by slide ribs on the right housing 50 and the left housing 58. Axial force imparted to the valve actuator 47 is transmitted to the pressurized canister valve 16 by the bearing of a valve actuator shoulder 42 on the nipple 41 of the pressurized canister valve 16. Axial force is imparted to the valve actuator 47 by a trigger 54 constrained to rotate about the trigger pivot 54*b* relative to the right housing 50 and the left housing 58.

The elastic tube 48 is contained in a confined space 60, the volume of which can be adjusted with an adjustable volume stop 51, which is constrained to rotate relative to the right housing 50 and the left housing 58 about a stop pivot 51*a*. The position of the adjustable volume stop 51 is set by a volume stop yoke 53*b* on the volume adjustment screw 53, which volume stop yoke 53*b* is pinned to the adjustment nut drive pin 52*a*. The rotation of the volume adjustment screw 53 relative to the right housing 50 and the left housing 58 drives a volume adjustment nut 52 axially along a volume adjustment screw shaft 53*d* of the volume adjustment screw 53 and sets the position of the adjustable volume stop 51.

To dispense liquid, a user depresses a trigger 54 by pushing on a trigger finger pad 54*c*. This causes the trigger 54 to rotate about a trigger pivot 54*b*, pushing a trigger seal 54*a* against the elastic tube 48, and pinching the elastic tube 48 against the valve actuator anvil 47*c*. The pinching of the elastic tube 48 creates a seal, closing the tube. The force transmitted to the valve actuator anvil 47*c* causes the valve actuator to bear upon the nipple 41 of the pressurized canister valve 16, opening the valve 16 and dispensing pressurized liquid. The liquid travels into the elastic tube 48 and expands the elastic tube until the pressure in the elastic tube 48 and the pressurized canister 10 are equalized. The final volume of the expanded elastic tube 48 is determined by the position of the adjustable volume stop 51 in the confined space 60.

The user then releases the trigger 54, closing the pressurized canister valve 16 and releasing the pinched elastic tube 48 and opening the tube 48 to atmospheric pressure. The opening of the tube 48 to atmospheric pressure allows the elastic tube 48 to contract, releasing the liquid through an expansion nozzle 55. Additionally, the return of the elastic tube 48 to its initial position also restores the initial position of the trigger 54.

A user may change the metered amount of liquid to be dispensed by the dispensing system 40 by the rotation of a volume adjustment screw knob 53*a*, which moves the adjustable volume stop 51 and sets the final volume of the confined space 60 containing the elastic tube 48. The user can view the setting of the adjustable volume stop 51 via the position of a volume indicator notch 52*c* relative to the right housing 50 and the left housing 58.

While the principles of the invention have been described herein, it is to be understood by those skilled in the art that this description is made only by way of example and not as a limitation as to the scope of the invention. Reference numerals corresponding to the embodiments described herein may be provided in the following claims as a means of convenient reference to the examples of the claimed subject matter shown in the drawings. It is to be understood however, that the reference numerals are not intended to limit the scope of the claims. Other embodiments are contemplated within the scope of the present invention in addition to the exemplary embodiments shown and described herein. Modifications and substitutions by one of ordinary skill in the art are considered to be within the scope of the present invention, which is not to be limited except by the recitations of the following claims.

What is claimed:

1. A dispensing system for dispensing a metered amount from a pressurized canister, said system comprising:

a housing configured to be coupled to said pressurized canister, said housing comprising a nozzle;

an elastic tube comprising a first end configured to be fluidly coupled to a dispense valve of said pressurized canister and a second end configured to be fluidly coupled to said nozzle, wherein at least a first portion of said elastic tube extends through a confined space disposed within said housing;

a trigger coupled to said housing, said trigger comprising a trigger seal, wherein:

movement of said trigger in a first direction relative to said housing causes said trigger seal to pinch a second portion of said elastic tube to seal said first portion of said elastic tube from said nozzle and opens said dispense valve such that said first portion of said elastic tube within said confined space expands until a pressure within said first portion of said elastic tube approximately equalizes with a pressure within said pressurized canister; and movement of said trigger in a second direction relative to said housing causes said dispense valve to close and causes said trigger seal to fluidly couple said first portion of said elastic tube to said nozzle such that said expanded elastic tube contracts and dispenses said metered amount through said nozzle until said pressure in said elastic tube is approximately equal to atmospheric pressure.

2. The dispensing system of claim 1, wherein movement of said trigger in said first direction causes said trigger seal to seal said first portion of said elastic tube from said nozzle prior to opening said dispense valve.

3. The dispensing system of claim 2, wherein movement of said trigger in said first direction is configured to cause said trigger seal to rotate and pinch said second portion of said elastic tube against a valve actuator anvil to seal said first portion of said elastic tube from said nozzle.

4. The dispensing system of claim 1, wherein movement of said trigger in said second direction causes said dispense valve to close prior to fluidly coupling said first portion of said elastic tube to said nozzle.

5. The dispensing system of claim 1, wherein said housing is configured to be removably coupled to said pressurized canister.

6. The dispensing system of claim 1, further comprising said pressurized canister.

7. A method for dispensing a metered amount from a pressurized canister comprising:

moving a trigger in a first direction relative to a housing to rotate a trigger seal and pinch a first portion of an elastic tube against a valve actuator anvil to seal a second portion of said elastic tube disposed within a confined space from a nozzle of said housing and to open a dispense valve of said pressurized canister such that said second portion of said elastic tube within said confined space is fluidly coupled to said pressurized canister and expands until a pressure within said second portion of said elastic tube approximately equalizes with a pressure within said pressurized canister; and moving said trigger in a second direction relative to said housing to close said dispense valve and fluidly couple said second portion of said elastic tube to said nozzle such that said expanded elastic tube contracts and dispenses said metered amount through said nozzle until said pressure in said elastic tube is approximately equal to atmospheric pressure;

wherein moving said trigger in said first direction pinches said first portion and seals said second portion of said elastic tube from said nozzle prior to opening said dispense valve.

8. The method of claim 7, wherein moving said trigger in said second direction closes said dispense valve prior to fluidly coupling said second portion of said elastic tube to said nozzle.

9. The method of claim 7, further comprising removably coupling said housing to said pressurized canister.

10. The method of claim 7, further comprising adjusting a volume of said confined space disposed within said housing.

11. A dispensing system for dispensing a metered amount from a pressurized canister, said system comprising:

a housing configured to be coupled to said pressurized canister, said housing comprising a nozzle;

an elastic tube comprising a first end configured to be selectively fluidly coupled to a dispense valve of said pressurized canister and a second end configured to be selectively fluidly coupled to said nozzle, wherein at least a first portion of said elastic tube extends through a confined space disposed within said housing;

means for adjusting a volume of said confined space; and a trigger coupled to said housing, said trigger comprising a trigger seal, wherein:

movement of said trigger in a first direction relative to said housing causes said trigger seal to pinch a second portion of said elastic tube to seal said first portion of said elastic tube from said nozzle and opens said dispense valve such that said first portion of said elastic tube within said confined space expands until a pressure within said first portion of said elastic tube approximately equalizes with a pressure within said pressurized canister; and movement of said trigger in a second direction relative to said housing causes said dispense valve to close and causes said trigger seal to fluidly couple said first portion of said elastic tube to said nozzle such that said expanded elastic tube contracts and dispenses said metered amount through said nozzle until said pressure in said elastic tube is approximately equal to atmospheric pressure.

12. The dispensing system of claim 11, wherein movement of said trigger in said first direction causes said trigger seal to seal said first portion of said elastic tube from said nozzle prior to opening said dispense valve, and wherein movement of said trigger in said second direction causes said dispense valve to close prior to fluidly coupling said first portion of said elastic tube to said nozzle.

13. The dispensing system of claim 11, wherein movement of said trigger in said first direction is configured to cause said trigger seal to rotate and pinch said second portion of said elastic tube against a valve actuator anvil to seal said first portion of said elastic tube from said nozzle.

* * * * *